United States Patent [19]

MacDonald

[11] 4,287,641

[45] Sep. 8, 1981

[54] SELF-CLOSING HINGE

[75] Inventor: Robert D. MacDonald, Mesa, Ariz.

[73] Assignee: Masco Corporation, Taylor, Mich.

[21] Appl. No.: 67,685

[22] Filed: Aug. 20, 1979

[51] Int. Cl.[3] ..... E05D 11/10

[52] U.S. Cl. ..... 16/139; 16/180

[58] Field of Search ..... 16/139, 172, 175, 180, 16/130, 141, 142

[56] References Cited

U.S. PATENT DOCUMENTS

| | | | |
|---|---|---|---|
| 2,734,222 | 2/1956 | Kiba | 16/172 |
| 3,255,484 | 6/1966 | MacDonald | 16/180 |
| 3,397,422 | 8/1968 | Youngdale | 16/180 |

*Primary Examiner*—Doris L. Troutman

*Attorney, Agent, or Firm*—Whittemore, Hulbert & Belknap

[57] ABSTRACT

A door hinge of the type adapted to urge a door to its closed position and to hold the door closed without the necessity of employing a latch mechanism. The hinge comprises a hinge member having an integral hinge pin portion formed thereon, a second hinge member having hinge portions rotatably mounted on the hinge pin, and a pressure member mounted on the second hinge member nd reacting against the first hinge member to urge the door to a closed position, the pressure member being operable to hold the hinge members in assembled condition.

7 Claims, 7 Drawing Figures

SELF-CLOSING HINGE

BACKGROUND OF THE INVENTION

Hinges of the general type disclosed herein are well-known and examples thereof may be found in my prior U.S. Pat. Nos. 3,205,532, 3,212,154, 3,228,058, and 3,255,484. The present invention is an improvement on hinges of this type which significantly reduces the cost of manufacture and installation thereof, as will be more fully described.

SUMMARY OF THE INVENTION

A hinge construction for latchless doors consisting of only three parts, namely, two hinge members respectively mounted on a door and a door frame and a deformable pressure member reacting between the hinge members. More particularly the hinge comprises a first hinge member having a mounting base and a flange portion with the outer end of the flange portion having an integral hinge pin formation thereon, a second hinge member having a mounting base and a flange portion with the flange portion of the second hinge member having spaced ears thereon receiving the hinge pin formation to pivotally connect the hinge members, a deformable pressure member mounted on the second hinge member, the flange portion of the first hinge member having a cylindrical portion coaxial with the hinge axis and a cam surface joined to the cylindrical portion by a generally rounded edge, the pressure member engaging said cylindrical portion from the full open position of the door to the near-closed position thereof and traversing said rounded edge and said cam portion as the door is closed from the said near-closed position thereof, the surfaces of said rounded edge and cam portion engaged by said pressure member as final closing occurs being progressively closer to said hinge axis and so arranged relative to said axis and pressure member that a force is applied to the pressure member along a line passing to one side of the hinge axis thereby producing a torque tending to close the door and move it past its closed position.

IN THE DRAWINGS

Figure 1:
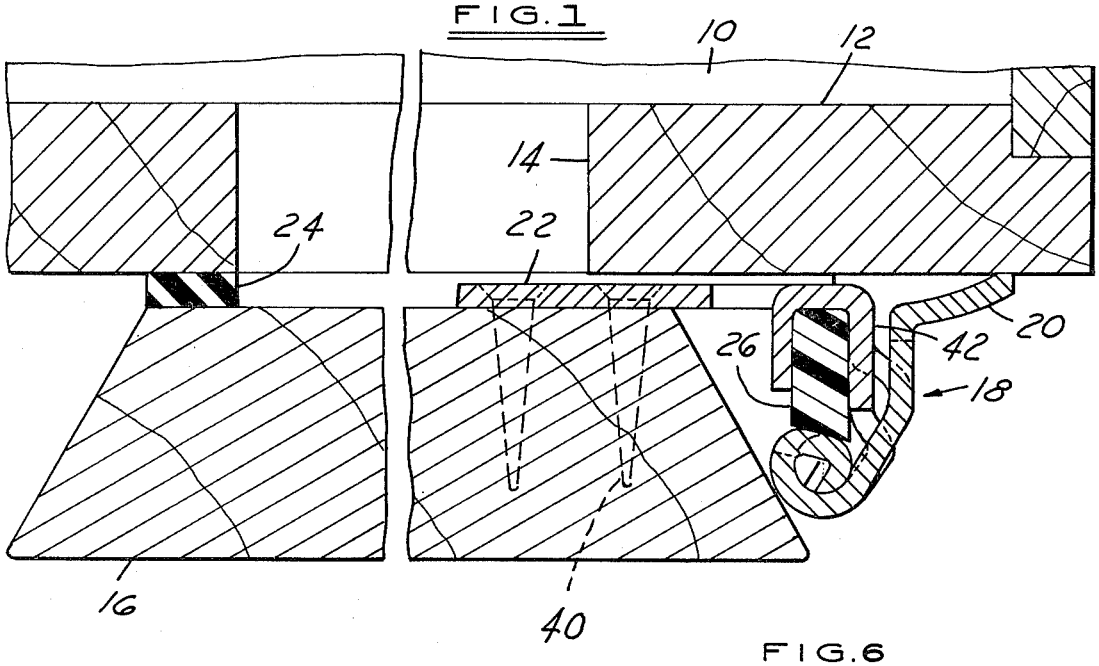
FIG. 1 is a horizontal sectional view of a cabinet having a door mounted thereon by a hinge of this invention, the section being taken on line 1—1 of FIG. 3.

As shown in FIG. 1 a cabinet 10 includes a frame member 12 surrounding the door opening 14 which provides access to the cabinet. A door 16 is mounted on the outer side of the cabinet frame 12 at one side thereof by a hinge assembly 18 which includes a first hinge member 20 adapted to be secured to the cabinet frame member 12 and a second hinge member 22 adapted to be secured to the inner surface of the door 16. The door 16 may be inwardly beveled as shown in FIG. 1 so as to eliminate the need for a door knob and the door is slightly larger than the door opening 14 so as to engage felt bumpers 24 secured to the frame member 12.

The hinge assembly 18 consists of only three parts thus providing a greatly simplified construction. In addition to the hinge members 20 and 22 the only other element of the hinge assembly is a deformable pressure member 26 which may be made of polyurethane or some other suitable material.

The hinge member 20 includes a mounting base 28 provided with holes 30 at its opposite ends to receive screws for securing hinge member 20 to the cabinet. The hinge member 20 also includes an outwardly projecting flange portion 32, which at its outer end is formed to have integral hinge pin formations 34 extending from the central portion 36 of the flange 32.

Figure 2:
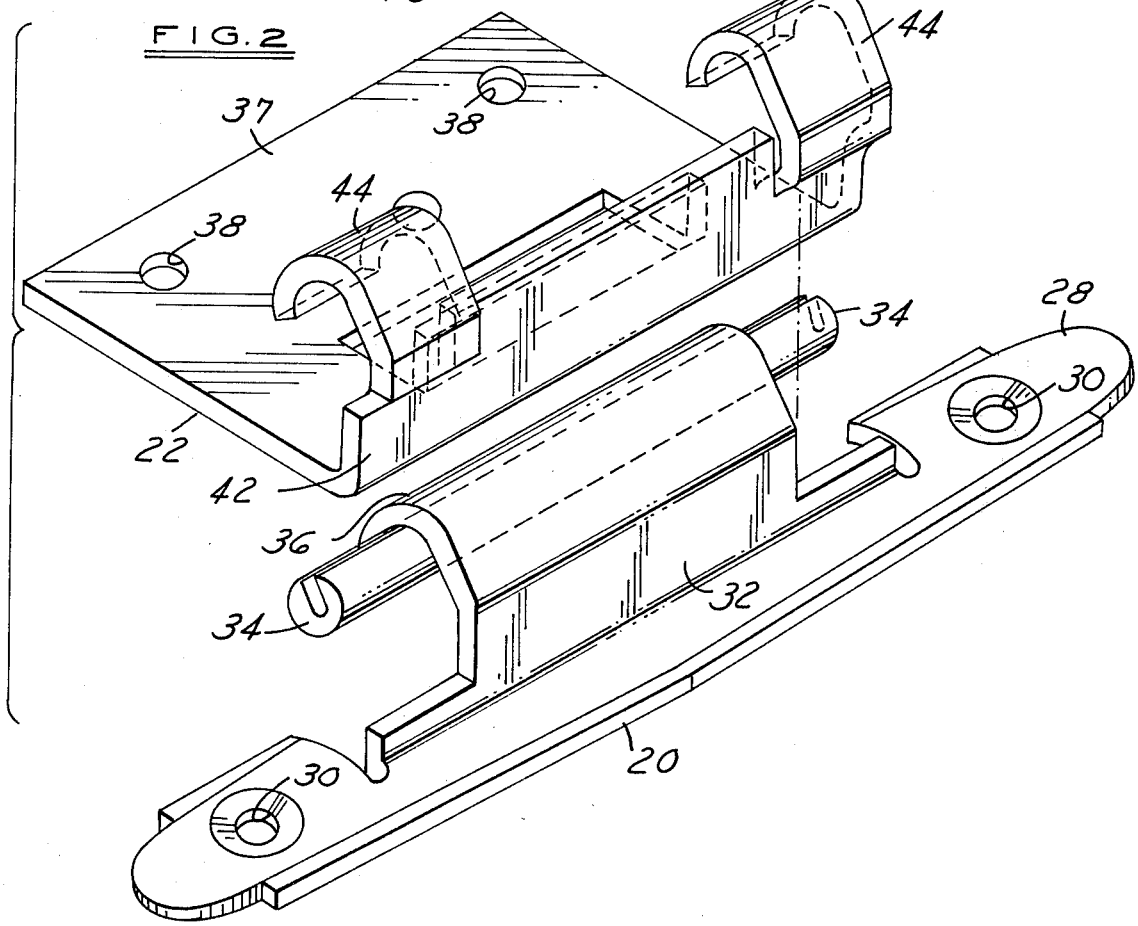
FIG. 2 is a perspective view of the two hinge members of the invention.

The hinge member 22 comprises a flat mounting base 37 having holes 38 to receive screws 40 for securing the hinge member 22 to the inner surface of the door 16. The hinge member 22 has an outwardly projected flange portion 42 which at its opposite end is formed as shown in FIG. 2 to provide spaced ears 44 which are adapted to receive the hinge pin formations 34 on the hinge member 20 to pivotally connect the hinge members.

Figure 4:
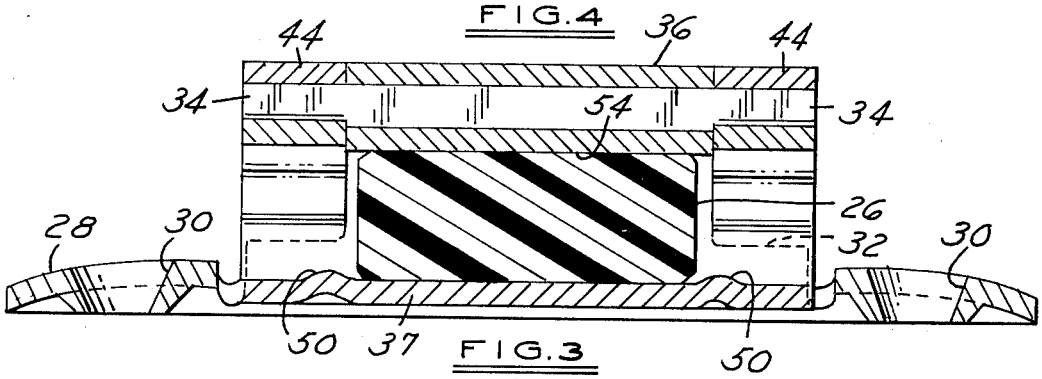
FIG. 4 is a sectional view taken on line 4—4 of FIG. 3.
Figure 3:
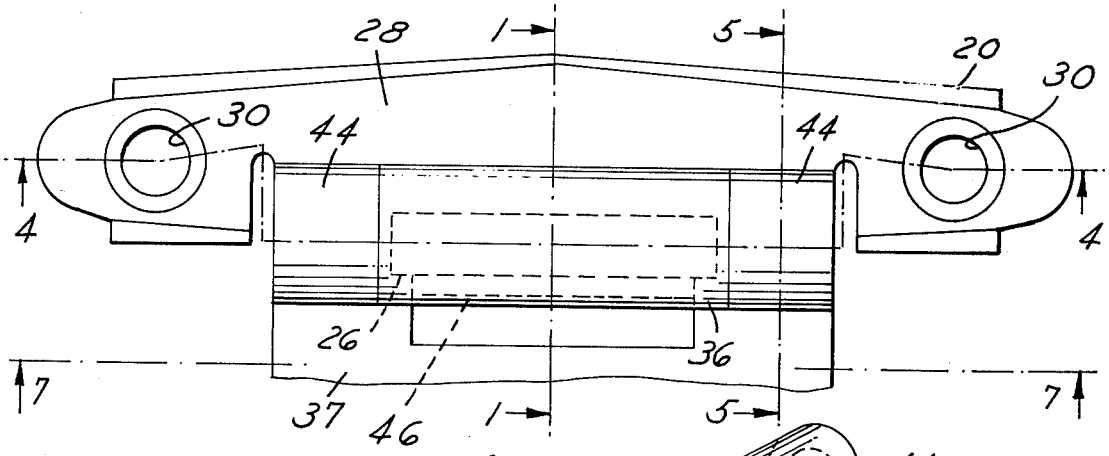
FIG. 3 is a fragmentary plan view of the hinge assembly.

The mounting base 37 of the hinge member 22 has an arm 46 projecting outwardly therefrom so that the arm 46 and the flange 42 together form a socket or receptacle 48 within which the pressure member 26 is confined. The pressure member 26 is not permanently secured within the socket 48 but rather may be easily inserted into and removed from the socket by a tool having a blunt end applied to one end of the pressure member 26 to slide it along its length into or out of the socket 48. As shown in FIG. 4 the base 37 of the hinge member 22 may be provided with dimples 50 located at opposite ends of pressure member 26 to prevent inadvertent removal of the pressure member from its confining socket. The material of which the pressure member 26 is made is sufficiently resilient to permit insertion and removal of the pressure member when desired.

Figure 6:
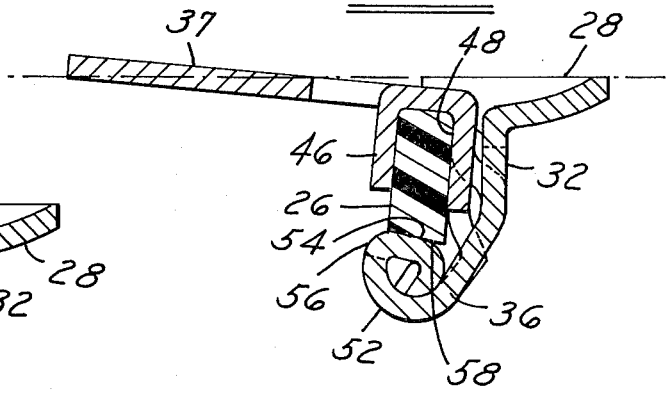
FIG. 6 is a horizontal sectional view of the hinge assembly per se and is also taken on line 1—1 of FIG. 3.
Figure 5:
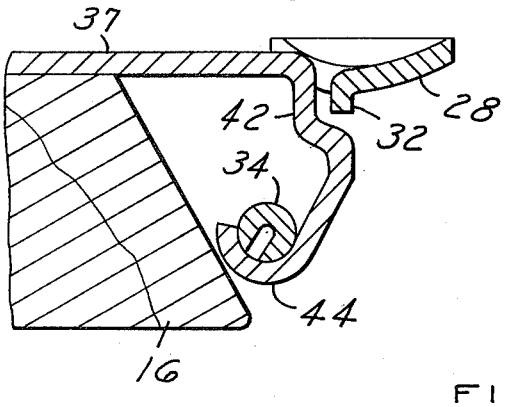
FIG. 5 is a sectional view taken on line 5—5 of FIG. 3.
Figure 7:
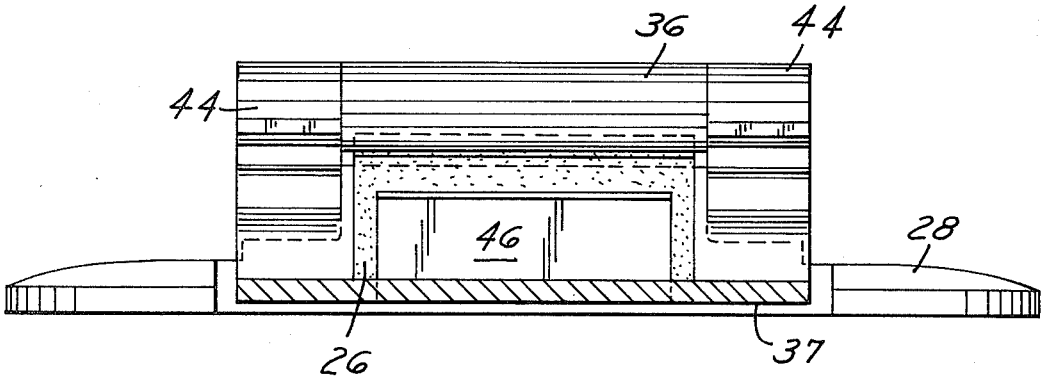
FIG. 7 is a sectional view taken on line 7—7 of FIG. 3.

As best shown in FIGS. 1 and 6, the main body portion 36 of flange 32 is formed, between the hinge pin formations 34, into a cylindrical portion 52 and a generally flat cam portion 54 joined by a rounded edge 56. The outer surface 58 of the pressure member 26 engages either the cylindrical portion 52, the rounded edge 56 or the cam portion 54 of hinge member 20 depending upon the extent of opening or closing the door. When the door is opened beyond about 25 to 30 degrees the pressure member 26 will move off of the cam surface 54 on to the round edge 56 and then on to the cylindrical portion 52 as the door is moved toward its full open position. When the pressure member engages the cylindrical portion 52 the force applied by the pressure member will pass through the hinge axis and thus there will be no tendency for the door to move in either direction. If the door is moved to its closed position, the pressure member 26 will first pass over the rounded edge 56 and then on to the cam surface 54. It will be noted that as the pressure member moves around the edge 56 and the cam portion 54, the engaged surfaces are progressively closer to the hinge axis and that the force of the pressure member will be applied along a line which passes to one side of the hinge axis thereby urging the door toward its closed position. As shown in FIG. 6 the hinge would actually move the door 16 beyond its closed position accept for the engagement of the door with the bumpers 24.

The height of the pressure member 26 is such that it is compressed between the base 37 of hinge member 22 and the rolled over end of the flange portion 36 when the door is in its fully closed position.

The forming of hinge member 20 as shown herein eliminates the need for a separate hinge pin to connect the two hinge members, thus reducing the cost of manufacture, although it is apparent that a separate hinge pin or pins could be secured to flange 36 if desired. It is also important to note that the cylindrical portion 52 and the cam portion 54 are formed directly on the hinge member 20 rather than on a separate hinge pin or other part thereby insuring the proper relationship between these surfaces and the pressure member when the hinge is in assembled condition. There are no sharp edges on the flange 36 which could cause undue wear of pressure member 26.

To assemble the hinge of this invention it is only necessary to turn the hinge member 22 until the hinge formations 44 thereon are engaged around the hinge pin formations 34 whereupon the hinge member 22 is rotated to its approximately closed position relative to hinge member 20. The pressure member 26 then may be slid lengthwise into the socket 48 and the pressure member 26 then reacts between the two hinge members to hold them in their assembled condition. This feature of the invention is of considerable importance not only in initial assembly and in installation in the field, but also permits easy removal of the pressure member for disassembly of the door from the cabinet and easy replacement thereof.

A further significant advantage of the present construction is that the pressure member 26 eliminates the need for any separate metal springs, which are subject to wear or breakage in use. Furthermore with this construction it is possible for the manufacturer to assemble the hinges as shown in FIG. 6 before the hinge members are plated or otherwise provided with an ornamental finish. Since the complete hinge assembly may be plated, the manufacturer is assured of obtaining an identical finish on both halves of the hinges. Since there are no metal springs used in the present construction, the plating of a completed hinge assembly will not adversely affect any part of the hinge.

What I claim as my invention is:

1. A hinge assembly comprising first and second hinge members, said first hinge member having a hinge pin formation thereon, said second hinge member having a hinge formation thereon receiving said hinge pin formation to pivotally connect said hinge members, said first hinge member having an engageable surface thereon, said surface including a cylindrical portion and a cam portion, and a deformable pressure member compressed between said second hinge member and said engageable surface of said first hinge member, said pressure member providing the sole means of holding said hinge members in assembled condition, said pressure member engaging said cylindrical portion of said engageable surface from the full open position of the hinge members to the near-closed position thereof and engaging said cam portion between the near-closed and fully closed positions thereof, said cam portion being arranged relative to the hinge axis and said pressure member so that the force applied by said pressure member passes to one side of the hinge axis thereby producing a torque tending to move said hinge members to the fully closed position.

2. A hinge axis thereby producing a torque tending to move said hinge assembly according to claim 1, wherein said pressure member is removably mounted on said second hinge member and means on said second hinge member for resisting inadvertent removal of said pressure member.

3. A hinge assembly according to claim 1, wherein said first hinge member has a base portion and a flange portion projecting therefrom, said hinge pin formation being integrally formed on the outer end of said flange portion at opposite sides thereof, said second hinge member having a base portion and a flange portion projecting outwardly therefrom, said hinge formation comprising spaced ears integrally formed on the outer end of said flange portion of said second hinge member.

4. A hinge assembly according to claim 3, wherein said engageable surface of said first hinge member is formed on the outer end of said flange portion of said first hinge member between said hinge pin formations.

5. A hinge assembly according to claim 4 wherein said second hinge member has an integral socket formed thereon and said pressure member is removably disposed within said socket, and means on said second hinge member to prevent inadvertent removal of said pressure member from said socket.

6. A hinge assembly comprising first and second hinge members one of which is attached to a door frame and the other to a door, said first hinge member having a base portion and a flange portion, the outer end of said flange portion having an integral hinge pin formation thereon, said second hinge member having a base portion and a flange portion, said flange portion of said second hinge member having a hinge formation thereon receiving said hinge pin formation to pivotally connect said hinge members, said second hinge member having a socket portion integral therewith, a deformable pressure member confined within said socket portion, said flange portion of said first hinge member having a cylindrical portion coaxial with the hinge axis and a cam portion joined by a generally rounded edge, said pressure member engaging said cylindrical portion from the full open position of the door to the near-closed position of the door and engaging first said rounded edge and then said cam portion as the door is closed from said near-closed position thereof, said pressure member being compressed between said second hinge member and the engaged surfaces of said first hinge member, the surfaces of said rounded edge and cam portion engaged by said pressure member as final closing occurs being progressively closer to said hinge axis and so arranged relative to said axis and said pressure member that the force applied by said pressure member passes to one side of the hinge axis thereby producing a torque tending to close the door and move it past its closed position.

7. A hinge assembly according to claim 6, wherein said pressure member provides the sole means of holding said hinge members in assembled condition.

* * * * *